US006116999A

United States Patent [19]

Montross

[11] Patent Number: 6,116,999

[45] Date of Patent: Sep. 12, 2000

[54] SANDER FOR A BULLNOSE CORNERBEAD AND METHOD OF USE

[76] Inventor: Christopher G. Montross, 17929 Cherry, Hesperia, Calif. 92345

[21] Appl. No.: 09/015,629

[22] Filed: Jan. 29, 1998

[51] Int. Cl.[7] ..... B24D 15/00

[52] U.S. Cl. ..... 451/524; 451/523; 451/525

[58] Field of Search ..... 451/523, 524, 451/525, 526, 495, 538, 539, 529, 530, 540, 913, 921, 902, 28, 521, 522, 510, 490

[56] References Cited

U.S. PATENT DOCUMENTS

| | | | |
|---|---|---|---|
| 1,570,177 | 1/1926 | Pointer | 451/495 |
| 1,927,574 | 9/1933 | Parks | 451/524 |
| 2,791,072 | 5/1957 | Barrett | 451/524 |
| 2,817,931 | 12/1957 | Houser | 451/525 |
| 2,982,059 | 5/1961 | Trussell | 451/523 |
| 3,123,946 | 3/1964 | Hoveland | 451/524 |
| 3,192,678 | 7/1965 | Buratti | 451/525 |
| 3,279,130 | 10/1966 | Nelson | 451/524 |
| 3,557,496 | 1/1971 | Martin | 451/523 |
| 4,774,789 | 10/1988 | Amalfi | 451/525 |
| 4,823,515 | 4/1989 | Blome | 451/523 |
| 5,690,547 | 11/1997 | Holland, Jr. et al. | 451/523 |

*Primary Examiner*—Derris H. Banks

*Attorney, Agent, or Firm*—Timothy Thut Tyson; Ted Masters; Freilich, Hornbaker & Rosen

[57] ABSTRACT

A sander (20) for a bullnose cornerbead (500) includes a body (22) having a bullnose-shaped concave surface (24) having a second radius of curvature ($R_2$) greater than the first radius of curvature ($R_1$) of the bullnose cornerbead (500). A flexible pad (26) is disposed on concave surface (24), and forms a third radius of curvature ($R_3$) which is greater than first radius of curvature ($R_1$), and less than second radius of curvature ($R_2$). Pad (26) does not fully extend to the edges (34) and (36) of sander (20), thereby leaving two gaps (38) and (40). A sheet of abrading material (700) such as sandpaper or emery cloth is clamped adjacent to flexible pad (26) and around concave surface (24) of sander (20). A handle (800) is connected to a pivotable connector (48) which only pivots in one plane (50).

11 Claims, 4 Drawing Sheets

500
502
503
504
505
506
508
R1
600
602
604
510
4

SANDER FOR A BULLNOSE CORNERBEAD AND METHOD OF USE

TECHNICAL FIELD

The present invention relates generally to the field of manual sanding tools, and more particularly to an improved sander which is used to sand filler coated bullnose cornerbeads.

BACKGROUND ART

Manual sanding tools are well known in the art. These tools typically comprise a body to which is affixed a sheet of abrasive material such as sandpaper or emery cloth. The tool is then grasped in the hand, or by a handle, and used to perform the desired sanding operation. For example, U.S. Pat. No. 1,927,574 shows a holder for sandpaper, emery cloth and the like for use in the cleaning of eggs and for wood polishing. A sheet of abrading material is stretched over a concave undersurface, and is held in place by a pin and slot arrangement. A layer of rubber, felt, or other suitable resilient or yieldable material is glued to the concave undersurface. U.S. Pat. No. 2,402,069 illustrates an abrading and polishing tool whose operative faces follow the contour of the surface against which they are applied. The tool consists of a frame of articulated construction, having for a basic element a cushion consisting of a fluid containing pad whose flexibility, combined with the responsiveness of the frame, permits the surface of the cushion, under pressure imposed on the frame, to conform to the contour of the surface being abraded or polished. U.S. Pat. No. 2,546,245 defines a sander wherein the bottom plate may be shaped in a manner to conform closely to the shape of the work which is being sanded. The sander includes a sheet-metal body having a pair of parallel inverted U-shaped jaws within which a pair of upwardly convergent flanges carried by a bottom plate are adapted to be engaged, with the flanges having means at each end thereof to hold the bottom plate against endwise movement. U.S. Pat. No. 2,817,931 discloses a dry wall angle sander for sanding the corners and angles of a plaster and like wall to make the wall angle clear and clean and particularly free from irregularities. The sander has a means for gripping emery cloth and sandpaper in a renewable condition so that the sander may be sharp and capable of perfect operation at all times. The gripping means includes two split tubes. U.S. Pat. No. 3,279,130 portrays a corner sander which is adapted to conform to and follow a corner wall portion when moved over large distances. The sander is in the form of an integral plate structure including two outside surfaces at an angle of substantially 270 with respect to each other. The apex portion of the surfaces is defined by a protuberance substantially bisecting this outward angle. This protuberance extends over the length of the outer surfaces and serves to engage the corner line of a wall corner when sandpaper is wrapped around the integral plate structure. Two clamping member secure the sandpaper to the sander. U.S. Pat. No. 4,774,789 comprises a corner sander having a sanding shoe of two angled plates. The plates from an integral angle in order to sand or abrade an external angle. The sanding shoe has a suitable mounting bracket to secure the shoe to a motor unit in a convenient manner for reciprocating the sanding shoe.

One particular sanding operation has special demands, which cannot be accommodated by the aforestated prior art sanding devices. In the wallboard construction industry for new homes, it is becoming evermore popular to fabricate 90° outside corners. These outside corners are not covered by paper tape and filler as are the joints between two planar sheets of wallboard. Rather, the outside corners are connected by a metal strip called a bullnose cornerbead. The bullnose cornerbead is nailed or screwed into position outside the perpendicular wallboard sheets and then the two planar strip portions are covered with a coating of wallboard filler. The proper sanding of the filled bullnose cornerbead is difficult because the sanding operation should fully expose the central rounded portion of the bullnose cornerbead, while not gouging the filler which covers the two outside planar strip portions. A flat sander has proven ineffective in this task since all of the sanding force is concentrated along a narrow strip of the bullnose, oftentimes exposing the metal. For this reason, hand sanding with a palm-held sanding sheet is the most common method of sanding a bullnose. Even so, it is very easy to apply too much pressure at one point and gouge the filler.

DISCLOSURE OF INVENTION

The present invention is directed to a sander for outside wallboard corners using bullnose cornerbeads. The sander is designed to smoothly sand the filler covering the two planar strips of the bullnose cornerbead without gouging the filler. The present invention realizes this objective by (1) making the radius of curvature of the concave surface of the sander slightly greater than the radius of curvature of the bullnose cornerbead, (2) leaving a outside gaps in the flexible pad covering on the concave surface to guard against gouging the flat portions of the outside corner, and (3) providing a handle connector which only pivots along the longitudinal axis of the sander so that the sander may be more precisely linearly moved along the filler coated bullnose cornerbead.

In accordance with a preferred embodiment of the invention, the bullnose cornerbead workpiece has a first radius of curvature $R_1$, and the sander has a body having a bullnose-shaped concave surface having a second radius of curvature $R_2$ which is greater than the first radius of curvature $R_1$ of the bullnose cornerbead. That is, the sander is shaped and dimensioned to loosely fit around the radius of curvature $R_1$ of the bullnose cornerbead.

In accordance with an important aspect of the invention, a flexible pad is disposed on the concave surface, the pad having a first side adjacent to the concave surface, and an opposite second side. The second side of the pad has a third radius of curvature $R_3$ which is greater than the first radius of curvature $R_1$ and less than said second radius of curvature $R_2$.

In accordance with an important feature of the invention, the concave surface has a central longitudinal axis, a first longitudinal edge, and an opposite second longitudinal edge. The pad is centered along the central axis, and extends to within a predetermined distance of the first and second edges, leaving gaps between the pad and the edges of the sander.

In accordance with another important aspect of the invention, the body of the sander has a top side opposite to the concave surface. Four selectively engagable clamps are disposed on the top side, and are used to hold a sheet of abrading material adjacent to the second side of the pad.

In accordance with another important feature of the invention, a pivotable connector for receiving a sanding handle is disposed on the top side of the sander. The connector only pivots in the longitudinal axis of the sander.

In accordance with an important aspect of the invention, the body includes a first planar portion and a second planar portion, the first and second planar portions forming an angle A of substantially 90°.

In accordance with an important feature of the invention, the body includes a first planar portion and a second planar portion, the first and second planar portions forming an angle A of slightly greater than 90°.

Other features and advantages of the present invention will become apparent from the following detailed description, taken in conjunction with the accompanying drawings, which illustrate, by way of example, the principles of the invention.

MODES FOR CARRYING OUT THE INVENTION

Figures 1, 2, 3, 4:
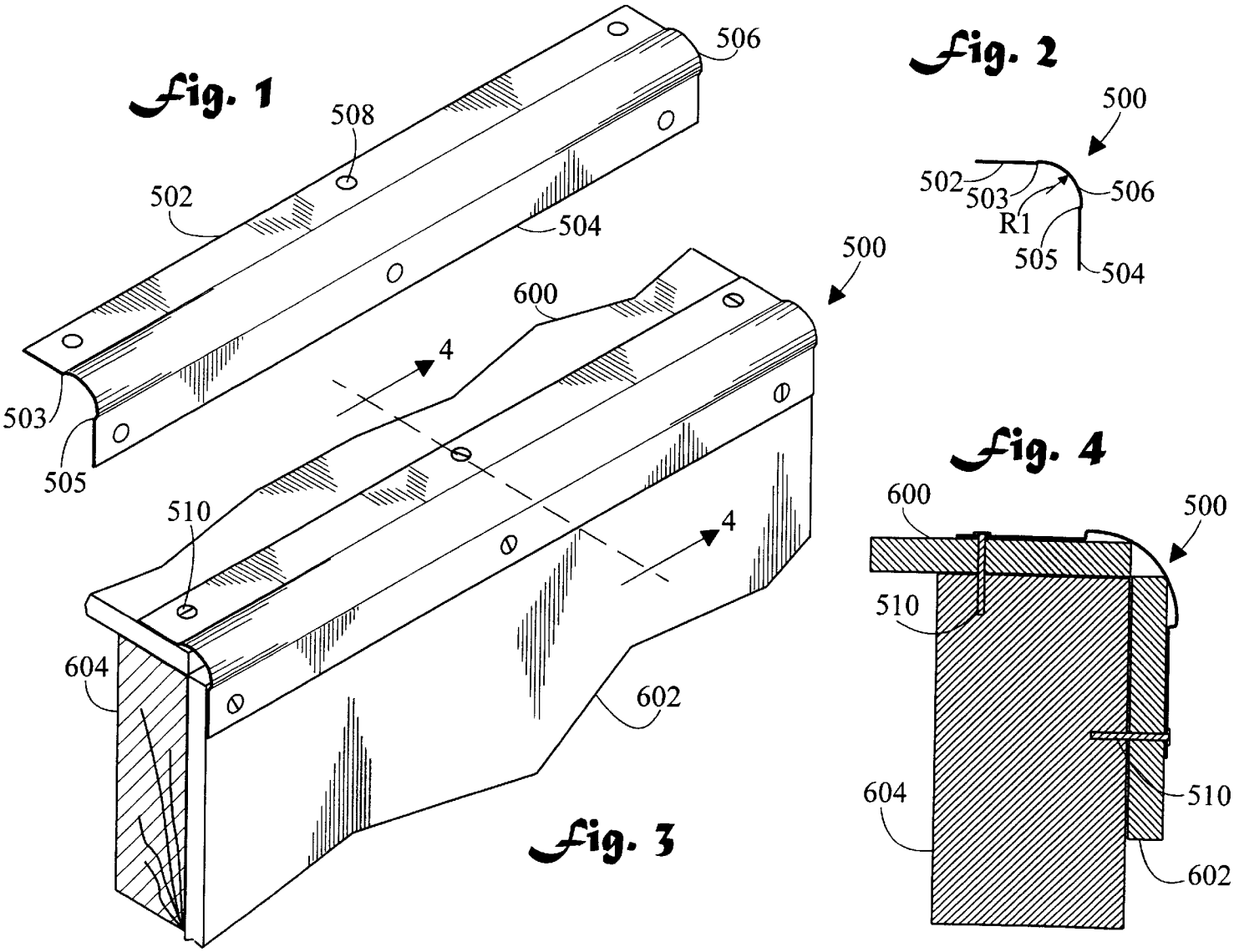
FIG. 1 is a perspective view of a bullnose cornerbead workpiece.
FIG. 2 is an end elevation view of the bullnose cornerbead.
FIG. 3 is a perspective view of the bullnose cornerbead installed around an outside corner of wallboard.
FIG. 4 is a cross sectional view along the line 4—4 of FIG. 3.
Figure 5:
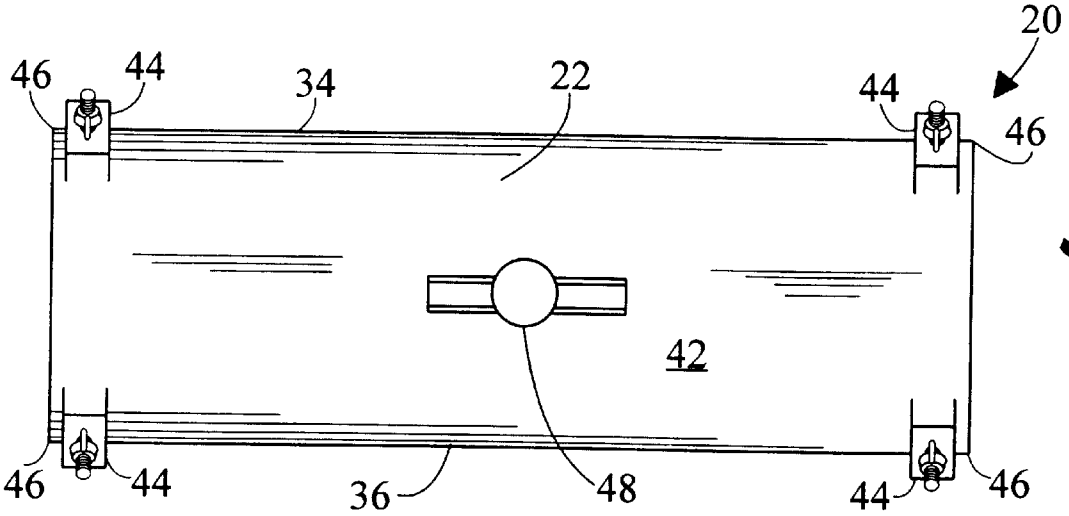
FIG. 5 is a top plan view of a sander in accordance with the present invention.
Figure 7:
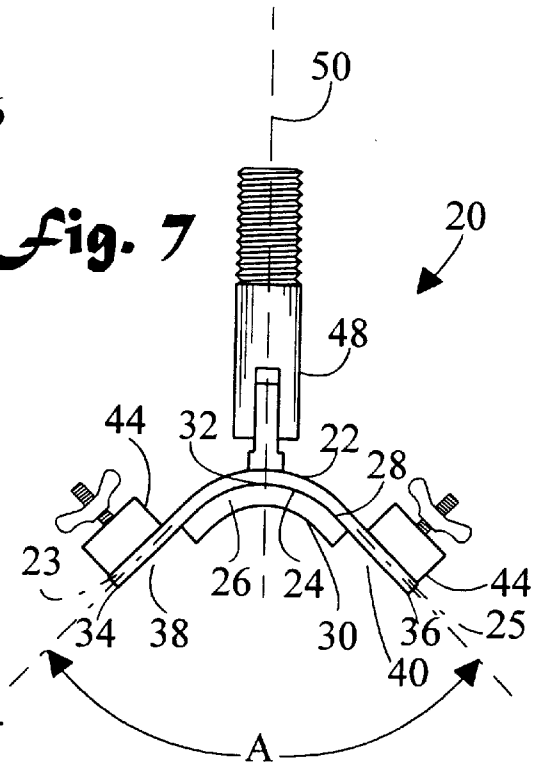
FIG. 7 is an end elevation view of the sander.
Figure 6:
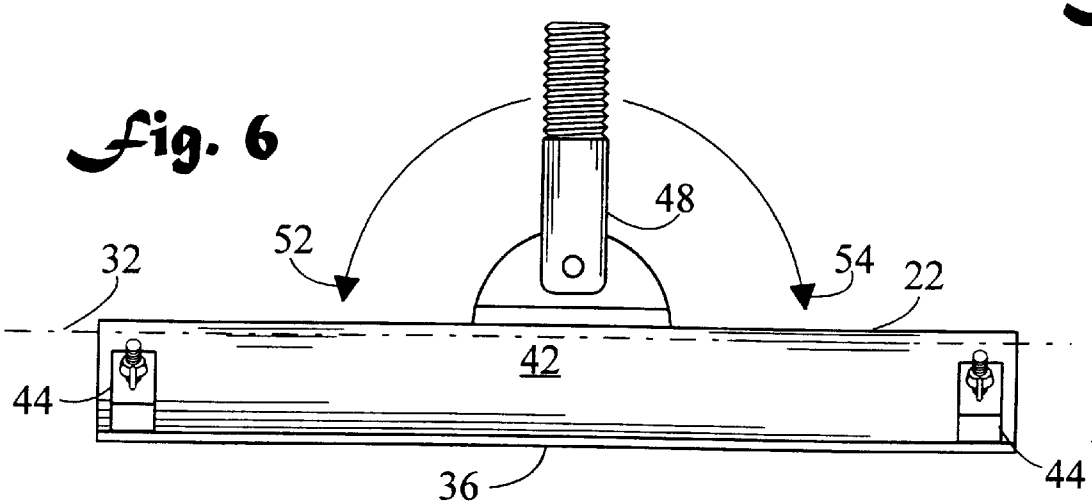
FIG. 6 is a side elevation view of the sander.

Referring initially to FIG. 1, there is illustrated a bullnose cornerbead 500. As used herein, the term "bullnose cornerbead" is a workpiece defined as two planar strips 502 and 504, typically made of metal, longitudinally joined by a central rounded portion 506 having a first radius of curvature $R_1$ (refer also to FIG. 2). Two lips 503 and 505 comprise the junction of central rounded portion 506 with planar strips 502 and 504. Lips 503 and 505 extend outwardly from planar strips 502 and 504 so that wallboard filler 606 may be applied to planar strips 502 and 504, and when properly sanded, form a smooth transitioning surface with central rounded member 506 (refer also to FIGS. 8 and 12).

The radius of curvature $R_1$ can vary for different size bullnose cornerbeads 500, typical sizes being 0.75 inches and 1.5 inches. In the most common embodiment the two planar strips 502 and 504 are perpendicular (forming a 90° angle as shown in FIG. 2, however other angular orientations such as 60 or 120° are also possible. Bullnose cornerbead 500 has spaced installation holes 508 to accommodate attachment to sheets of wallboard and a supporting structure through the use of nails or screws.

FIG. 2 is an end elevation view of the bullnose cornerbead 500.

FIG. 3 shows bullnose cornerbead 500 installed around an outside corner of wallboard. The outside corner is comprised of a first sheet of wallboard 600 perpendicularly connected to a second sheet of wallboard 602. The connection is effected by a supporting structure 604 such as a two-by-four. Nails or screws 510 are placed through the installation holes 508, penetrate the wallboard 600 and 602, and are anchored in the supporting structure 604.

FIG. 4 is a cross sectional view of the installed cornerbead 500 along the line 4—4 of FIG. 3.

Now referring to FIGS. 5–8, there are illustrated top plan, side elevation, end elevation, and enlarged end elevation views respectively of a sander in accordance with the present invention, generally designated as 20. Sander 20 has a body 22 having a bullnose-shaped concave surface 24. As used herein, the term "bullnose-shaped concave surface" pertains to a surface having a shape defined by two planar surfaces longitudinally joined by a central rounded surface having a radius of curvature. Bullnose-shaped concave surface 24 has a second radius of curvature $R_2$ which is greater than the first radius of curvature $R_1$ of bullnose cornerbead 500. A flexible pad 26 is disposed on concave surface 24. Body 22 has a first planar portion 23 and a second planar portion 25. In a preferred embodiment, first planar portion 23 and second planar portion 25 form an angle A of substantially 90° which matches the 90° angle of bullnose cornerbead 500. In another preferred embodiment, angle A is slightly greater than 90°. By opening the angle slightly, one of the filler-coated planar strips 502 or 504 may be sanded without sanding the other strip.

Flexible pad 26 is fabricated from rubber or some other resilient cushioning material, and is attached to concave surface 24 by an adhesive or other mechanical means. Flexible pad 26 serves to assist the sanding operation by providing a resilient surface which is less likely to gouge the wallboard filler 606 as it is being sanded (refer also to FIG. 11). A pad 26 thickness of approximately 0.25 inches has been found useful. Flexible pad 26 has a first side 28 which is adjacent to concave surface 24, and an opposite second side 30. Second side 30 has a third radius of curvature $R_3$ which is greater than the first radius of curvature $R_1$ of bullnose cornerbead 500, and less than second radius of curvature $R_2$ of concave surface 24. Concave surface 24 has a central longitudinal axis 32, a first longitudinal edge 34, and an opposite second longitudinal edge 36. Flexible pad 26 is centered along central axis 32, and extends to within a predetermined distance D of first 34 and second 36 edges. Since flexible pad 26 does not extend all the way to the edges 34 and 36 of concave surface 24, two gaps 38 and 40 are created. Gaps 38 and 40 are an important feature of the invention in that they prevent the outside edges of flexible pad 26 from gouging the wall board filler 606 (applied to planar strips 502 and 504) if sander 20 is inadvertently tilted during the sanding operation (refer to FIG. 12). That is, sander 20 may be tilted a greater amount as it moves along bullnose cornerbead 500 without producing a gouging effect, than it could be tilted if pad 26 extended all the way to edges 34 and 36. In a preferred embodiment, predetermined distance D is selected so that when sander 20 is placed around the bullnose cornerbead 500, second side 30 of flexible pad 26 extends slightly beyond lips 503 and 505 of bullnose cornerbead 500 (refer to FIG. 8).

Body 22 has a top side 42 opposite concave surface 24. A plurality of selectively engagable clamps 44 for holding a sheet of abrading material 700 (refer to FIG. 9) adjacent to second side 30 of flexible pad 26 are disposed on top side 44. In a preferred embodiment, four clamps 44 are disposed on top side 42 near the four corners 46 of body 22. Also in a preferred embodiment, the clamps comprise a threaded rod which is attached to top side 42, a housing which receives the threaded rod, and a wing nut which clamps the sheet of abrasive material 700 between top side 42 and the housing.

Sander 20 further includes a threaded pivotable connector 48 for receiving a screw-on sanding handle 800 (refer to FIG. 10) disposed on top side 42. A plane 50 longitudinally bisects concave surface 24, and connector 48 is only pivotable in plane 50 in directions 52 and 54. In a preferred embodiment, connector 48 can pivot through approximately 180°. By making connector 48 and therefore sanding handle 800 only pivotable along the longitudinal axis of sander 20, the user can exercise greater control over the sanding process by sanding in a straight line along the bullnose cornerbead 500. This is in sharp contrast to conventional flat sanders in which the handle can swivel through 360°.

Figures 8, 9, 10:
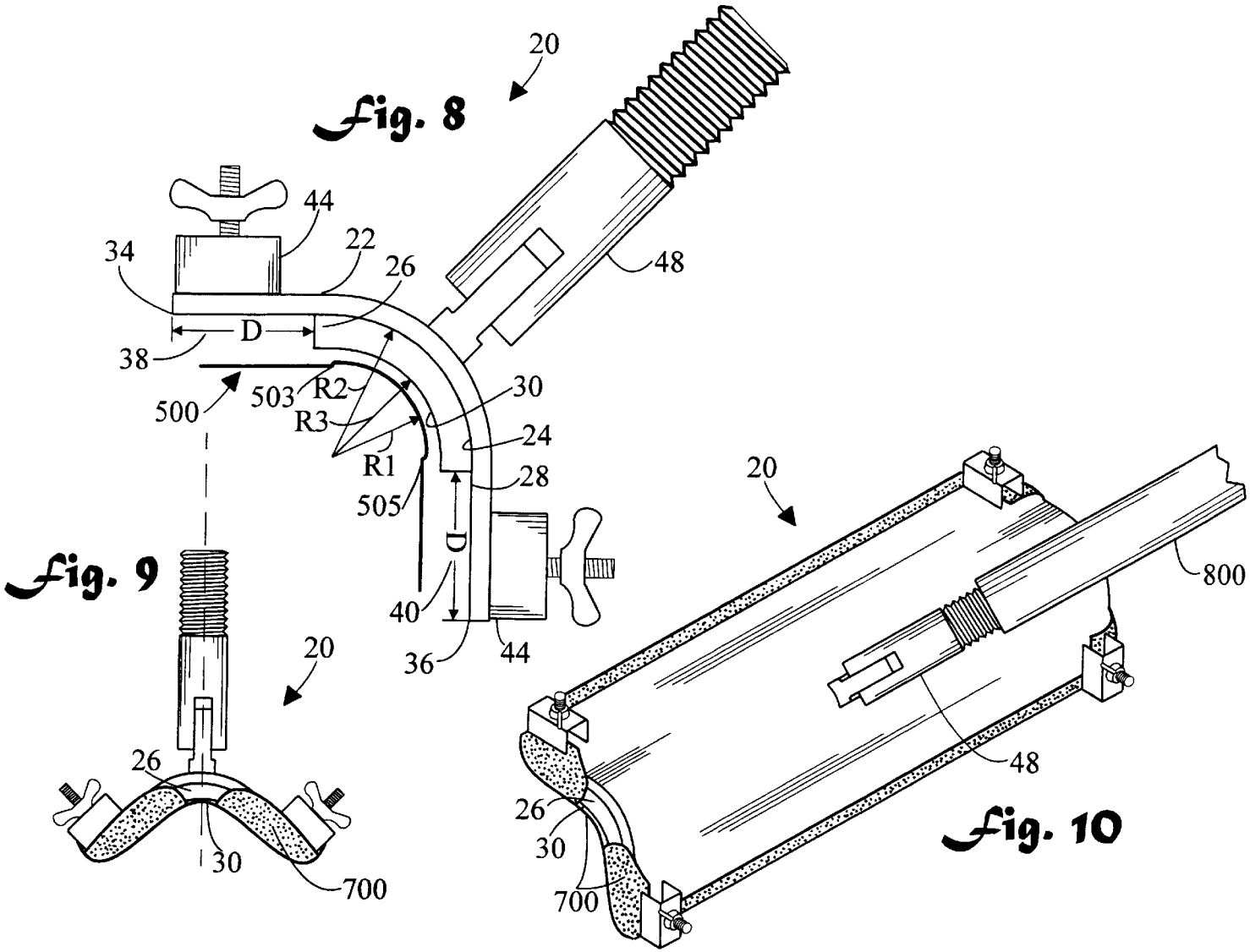
FIG. 8 is an enlarged end elevation view of the sander placed adjacent to the bullnose cornerbead.
FIG. 9 is an end elevation view of the sander with a sheet of abrading material installed on the sander.
FIG. 10 is a perspective view of the sander with the sheet of abrading material installed.

FIG. 9 is an end elevation view and FIG. 10 is a perspective view of sander 20 showing a sheet of abrading material 700, such as sandpaper or emery cloth, installed on the sander 20. The sheet of abrading material 700 is positioned adjacent to second side 30 of flexible pad 26, with the abrading material facing away from pad 26. The abrading material 700 is clamped around the ends (vs. side edges) of sander 20. This clamping arrangement permits standard die-cut flat sander sheets to be used in the present invention.

Figures 11, 12:
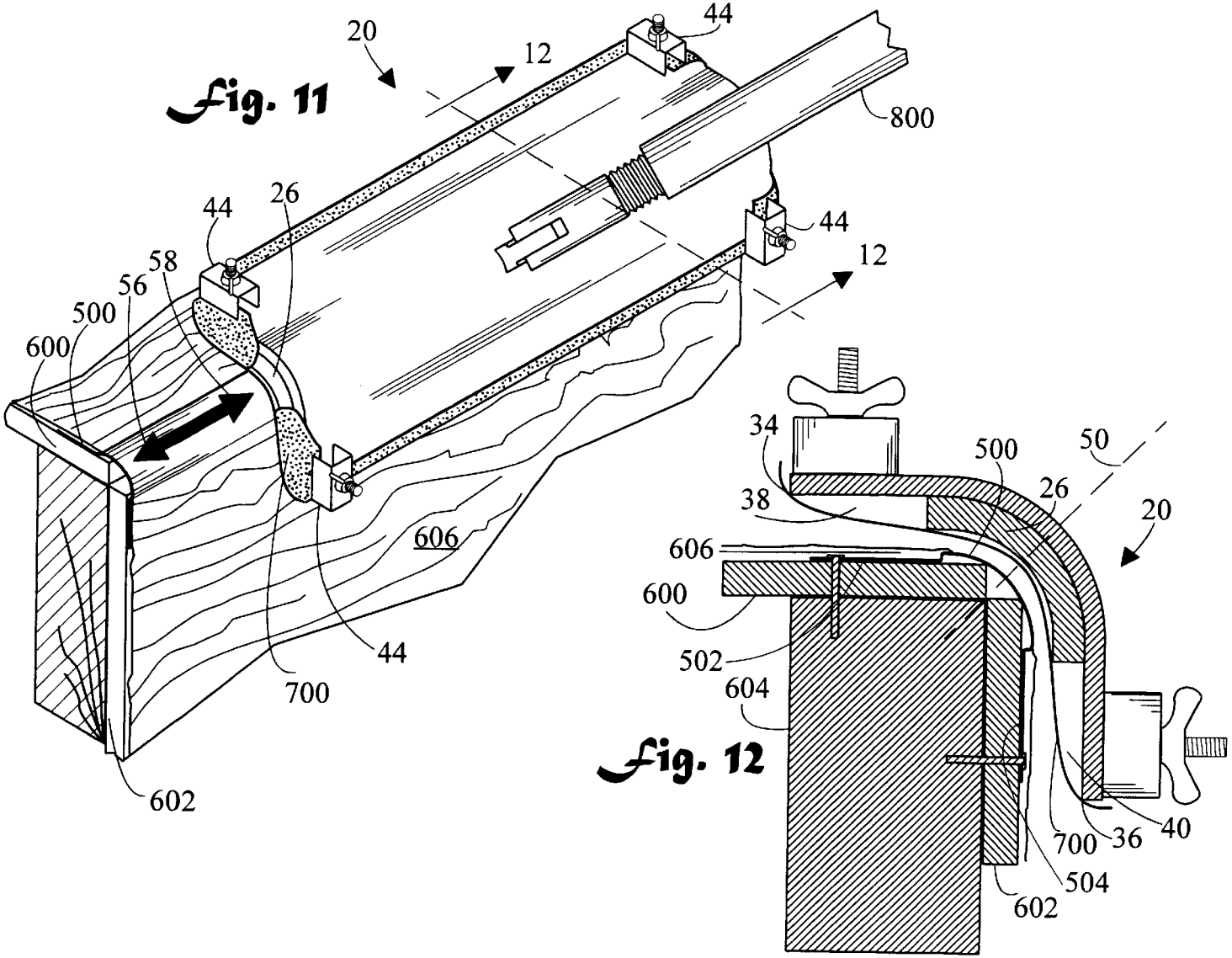
FIG. 11 is a perspective view of the sander positioned to sand a outside corner to which a wallboard filler has been applied; and, FIG. 12 is a cross sectional view along the line 12—12 of FIG. 11.

FIG. 11 is a perspective view of the sander 20 positioned to sand a outside wallboard corner and bullnose cornerbead 500 to which a wallboard filler 606 has been applied, and FIG. 12 is a cross sectional view along the line 12—12 of FIG. 11. A coating of filler 606 has been spread over wallboards 600 and 602 and planar strips 502 and 504 of connecting cornerbead 500. The sheet of abrading material 700 is attached to sander 20 using the four clamps so that the abrading material faces away from flexible pad 26. Sander 20 is then placed around the filler 606 coated bullnose cornerbead 500. The abrading material 700 is then pressed against filler 606, and sander 20 is linearly moved back and forth in directions 56 and 58 along the bullnose cornerbead 500 to smooth filler 606. Since third radius curvature $R_3$ of flexible pad 26 is greater than first radius of curvature $R_1$ of bullnose cornerbead, sander 20 may be positioned to sand one planar strip 502 or 504 but not the other. In a preferred embodiment, $R_3$ is approximately one-eighth of an inch greater than $R_1$.

Finally, handle 800 which is only pivotable in plane 50 is used to move sander 20 along the filler 606 coated bullnose cornerbead 500.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A bullnose cornerbead sander, the bullnose cornerbead having a first radius of curvature $R_1$, said sander comprising:

a body having a bullnose-shaped concave surface having a second radius of curvature $R_2$ greater than the first radius of curvature $R_1$ of the bullnose cornerbead; and, said body having a first planar portion and a second planar portion, said first and second planar portions forming an angle A of substantially 90°.

2. A bullnose cornerbead sander, the bullnose cornerbead having a first radius of curvature $R_1$, said sander comprising:

a body having a bullnose-shaped concave surface having a second radius of curvature $R_2$ greater than the first radius of curvature $R_1$ of the bullnose cornerbead;

a flexible pad disposed on said concave surface;

said pad having a first side adjacent to said concave surface, and an opposite second side; and, said second side having a third radius of curvature $R_3$ greater than the first radius of curvature $R_1$ and less than said second radius of curvature $R_2$.

3. A sander according to claim 2, the bullnose cornerbead having two spaced lips, said sander further including:

said concave surface having a central longitudinal axis, a first longitudinal edge, and an opposite second longitudinal edge;

said pad centered along said central axis;

said pad extending to within a predetermined distance of said first and second edges; and, said predetermined distance selected so that when said sander is placed around the bullnose cornerbread, said second side of said flexible pad extends slightly beyond the lips of the bullnose cornerbread.

4. A sander according to claim 3, the bullnose cornerbead having two planar strips longitudinally joined by a central rounded portion, a junction of the two planar strips and the central rounded portion forming two lips, said predetermined distance selected so that when said sander is placed around the bullnose cornerbead, said second side of said pad extends slightly beyond the lips of the bullnose cornerbead.

5. A sander according to claim 2, further including:

a sheet of abrading material adjacent to said second side of said pad, with the abrading material facing away from said pad.

6. A sander according to claim 2, further including:

said body have a top side opposite said concave surface;

a plurality of selectively engagable clamps disposed on said top side; and, said plurality of clamps for holding a sheet of abrading material adjacent to said second side of said pad.

7. A sander according to claim 6, further including:

said body having four corners; and, four said clamps disposed on said top side near said four corners.

8. a bullnose cornerbead sander, the bullnose cornerbead having a first radius of curvature $R_1$, said sander comprising:

a body having a bullnose-shaped concave surface having a second radius of curvature $R_2$ greater than the first radius of curvature $R_1$ of the bullnose cornerbead; and, a pivotable connector disposed on said top side; and, said connector for receiving a sanding handle.

9. A sander according to claim 8, further including:

a plane longitudinally bisecting said concave surface; and, said connector only pivotable plane.

10. A method of sanding a bullnose cornerbead having two planar strips joined by a central rounded portion, comprising the steps of:

providing the bullnose cornerbead having a filler disposed on the two planar strips, the bullnose cornerbead having the first radius of curvature $R_1$, and two spaced lips;

providing a sander comprising, a body having a bullnose-shaped concave surface ahving a second radius of curvature $R_2$ greater than the first radius of curvature $R_1$ of the bullnose cornerbead, a flexible pad disposed on said concave surface, said pad having a first side adjacent to said concave surface, and an opposite second side, said second side having a third radius of curvature $R_3$ greater than the first radius of curvature $R_1$ and less than said second radius of curvature $R_2$, said concave surface having a central longitudinal axis, a first longitudinal edge, and an opposite second longitudinal edge, said pad centered along said central axis, said pad extending to within a predetermined distance of said first and second edges, said predetermined distance selected so that when said sander is placed around the bullnose cornerbead, said second side of said flexible pad extends slighlty beyond the lips of the bullnose cornerbead, said body have a top side opposite said concave surface, said body having four corners, four selectively engagable clamps disposed on said top side near said four corners;

providing a sheet of abrading material;

using said four clamps to attach the sheet of abrading material adjacent to said second side of said pad with the abrading material facing away from said pad;

placing said sander around the filler coated bullnose cornerbead;

pressing the abrading material against the filler; and, moving said sander linearly along the bullnose cornerbead to smooth the filler.

11. The method according to claim 10, further including the steps of:

providing a pivotable connector disposed on said top side;

providing a plane longitudinally bisecting said concave surface, said connector only pivotable in said plane;

connecting a sanding handle to said connector; and, using said handle to move said sander.

* * * * *